US011248370B1

(12) United States Patent
Hillje

(10) Patent No.: US 11,248,370 B1
(45) Date of Patent: Feb. 15, 2022

(54) PLUMBING FOR PREFAB BATHROOM

(71) Applicant: Jochen Hillje, Houston, TX (US)

(72) Inventor: Jochen Hillje, Houston, TX (US)

( * ) Notice: Subject to any disclaimer, the term of this patent is extended or adjusted under 35 U.S.C. 154(b) by 0 days.

(21) Appl. No.: 17/203,527

(22) Filed: Mar. 16, 2021

(51) Int. Cl.
*E03C 1/122* (2006.01)
*E04B 5/02* (2006.01)
*E03C 1/01* (2006.01)

(52) U.S. Cl.
CPC ..... *E03C 1/122* (2013.01); *E03C 1/01* (2013.01); *E04B 5/02* (2013.01)

(58) Field of Classification Search
CPC ..... E03C 1/122
USPC ... 4/524, 556, 557, 596, 145, 664, 663, 665; 156/245; 296/164, 168
See application file for complete search history.

(56) References Cited

U.S. PATENT DOCUMENTS 3,668,710 A * 6/1972 Dowd ..... A47K 3/28 4/597
3,852,834 A * 12/1974 Morris ..... A47K 3/28 4/609
4,118,854 A * 10/1978 Krafft ..... E03D 11/143 29/428
4,261,613 A * 4/1981 Alford ..... B60P 3/1016 296/156
5,556,498 A * 9/1996 Blanchard ..... B29C 65/00 156/245
5,652,976 A * 8/1997 Hopper ..... A47K 4/00 4/604
5,911,518 A * 6/1999 Jurek ..... E03F 5/0408 4/596
5,978,983 A * 11/1999 Queen ..... A47K 3/006 4/555
6,378,141 B1 * 4/2002 Lew ..... E03D 11/16 4/252.1
2005/0161974 A1 * 7/2005 Atcravi ..... B60P 3/34 296/164
2005/0210576 A1 * 9/2005 Guerin ..... A47K 3/28 4/596
2008/0258497 A1 * 10/2008 Oliver ..... B60R 15/00 296/168
2011/0041418 A1 * 2/2011 Meserini ..... E04B 1/34869 52/79.9
2013/0145541 A1 * 6/2013 Krasilnikov ..... A61H 33/066 4/524
2017/0341562 A1 * 11/2017 Knight ..... B60P 3/34
2018/0238046 A1 * 8/2018 Hillje ..... E04B 1/34869
2018/0370414 A1 * 12/2018 Wieth ..... B60P 3/34
(Continued)

*Primary Examiner* — Lori L Baker
(74) *Attorney, Agent, or Firm* — Nolte Lackenbach Siegel

(57) ABSTRACT

A plumbing assembly to support a modular bathroom positioned within a shipping container include: a subfloor positioned above a main floor by less than about 7 inches; a toilet positioned and a shower positioned on the subfloor; a sink positioned on a vertical wall adjacent the subfloor; and a plumbing assembly between the subfloor and the main floor that receives fluid from the shower, the toilet, and the sink. The plumbing assembly includes: a shower drain pipe, sink drain pipe, and a main drain pipe draining the shower drain pipe, the sink drain pipe, and the toilet. The main drain pipe diameter is 3 times larger than the shower drain pipe diameter. The shower drain pipe is connected to the main drain pipe in an eccentric position and at a radial position of the main drain pipe closest to the main floor of the shipping container.

7 Claims, 6 Drawing Sheets

(56) References Cited

U.S. PATENT DOCUMENTS

| | | | | |
|---|---|---|---|---|
| 2019/0316338 | A1* | 10/2019 | Pytlewski | E03D 11/17 |
| 2020/0131756 | A1* | 4/2020 | Devine | E03C 1/1227 |
| 2020/0290498 | A1* | 9/2020 | Hunter | A47K 3/32 |
| 2020/0317111 | A1* | 10/2020 | Mundt | B60P 3/34 |
| 2021/0079645 | A1* | 3/2021 | Wheeler | E04B 1/34869 |

* cited by examiner

PLUMBING FOR PREFAB BATHROOM

BACKGROUND

Most residential and commercial buildings are built on concrete slab foundations. Some residential buildings are still constructed on concrete piers, and in coastal areas, they are often built on wooden piers, but seldom concrete piers. These buildings on concrete slab foundations require underground plumbing. The plumbing is placed after the channels for the grade beams are dug and the forms are set in place. After that procedure, the entire area of the slab, including the grade beam channels, are covered with thick plastic sheeting. The next step involves carefully installing the underground PVC plumbing pipes. After installation, the pipes have to be sealed and plugged as they will be tested for leaks by filling them with water. The final step of the slab preparation process involves the installation of the steel reinforcing bars required for the foundation. Before the concrete can be poured for the foundation, the governing agency, usually the City or County, will inspect the plumbing work, the reinforcing steel, the final measurements for the correct location of the concrete slab and perform the leak test. Building on piers is an easier task from an underground plumbing standpoint, as there is very little underground plumbing. The majority of the plumbing work is in the subfloor, which is above ground and accessible from ground level in most instances. The installation of plumbing can be done much later than the foundation stage.

Neither of the above noted plumbing situations is applicable to modular homes, and specifically to homes built in modular or movable structures. For example, a very popular method of building modular housing is to use metal shipping containers, and when installing plumbing in these structures neither the underground method or the method used in pier or stilt type structures can be utilized. The underground method is unsuitable as the shipping containers rarely sit directly on the ground and further, it's undesirable to have penetrations through the flooring of the shipping container. Similarly, installing the plumbing features below the flooring of the container would also be undesirable as this plumbing would then be either exposed to the elements or again in the ground. As such, for modular homes there is a need for a plumbing scheme that may be used to keep the plumbing above the shipping container floor while still allowing for conventional plumbing conveniences such as sinks, toilets, and showers.

BRIEF DESCRIPTION OF THE DRAWINGS

The present disclosure may be understood from the following detailed description when read with the accompanying Figures. In accordance with the standard practice in the industry, various features are not drawn to scale. In fact, the dimensions of the various features may be arbitrarily increased or reduced for clarity of discussion. So that the manner in which the above recited features, advantages and objects of the present disclosure are attained and can be understood in detail, a more particular description of the invention, briefly summarized above, may be had by reference to the embodiments thereof which are illustrated in the appended drawings. It is to be noted, however, that the appended drawings illustrate only typical or exemplary embodiments of this disclosure and are therefore not to be considered limiting of its scope, for the disclosure may admit to other equally effective embodiments.

FIG. 5 illustrates an exemplary final installation of the novel plumbing assembly of the present disclosure that support three bathroom fixtures, namely a shower or tub, a toilet, and a sink, all on a raised platform that is between 5 and 7 inches off a base floor (container floor) within which the present disclosure is mounted in.

DETAILED DESCRIPTION

The above general description of the method and the following detailed description are merely illustrative of the subject invention and modes, advantages and particulars of this invention (can) be readily suggested to those skilled in the art without departing from the spirit and scope of the invention. In the following, reference is made to embodiments of the invention. However, it should be understood that the invention is not limited to specific described embodiments. Instead, any combination of the following features and elements, whether related to different embodiments or not, is contemplated to implement and practice the invention. Furthermore, in various embodiments the invention provides numerous advantages over the prior art. However, although embodiments of the invention may achieve advantages over other possible solutions and/or over the prior art, whether or not a particular advantage is achieved by a given embodiment is not limiting of the invention. Thus, the following aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s).

Figure 1:
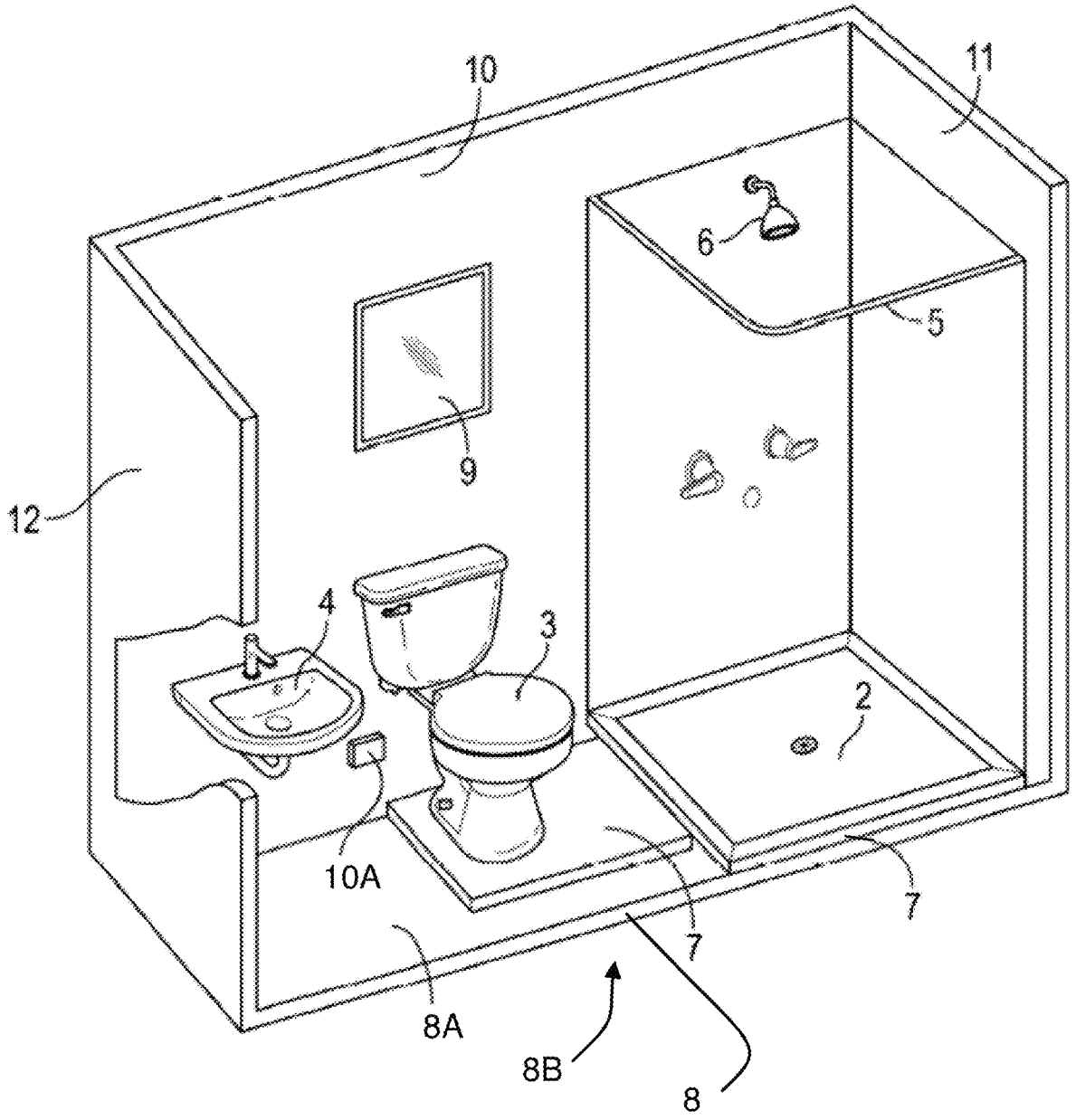
FIG. 1 illustrates a three-sided enclosure representing an exemplary embodiment of the present disclosure.

FIG. 1 illustrates a three-sided enclosure representing an exemplary embodiment of the present disclosure having a floor 8 (illustrated with a top floor surface 8A and a bottom floor surface 8B), back wall 10, right wall 11 and left wall 12. The figure shows all appliances in place: shower base 2, toilet 3, sink 4, electric breaker box 9, and water heater 10A. In accordance with the present invention, the Pre-fab Utility Wall System, FIG. 1, consists of a partial enclosure of seven feet six inches by three feet made of either a wood or steel frame. The partial enclosure generally represents a modular unit to be installed in the end portion of a shipping container (not shown) where a bathroom facility is to be placed. The end wall of the shipping container aligns with the one back wall 10 of the bathroom enclosure. The side walls of the shipping container will correspondingly align with the two sidewalls (right wall 11 and left wall 12) of the bathroom enclosure. The fourth wall of the bathroom enclosure (not shown) will be an interior wall that is not directly adjacent to a container exterior wall that encloses the bathroom facility. The bathroom facility generally includes a shower on the right-hand side that has a shower base 2 that collects water into a central drain aperture in the shower base 2. The upper portion of the shower area may be defined by a shower roof 5 that may be suspended below the container roof (not shown) or maybe integral with the container roof. The shower base 2 sits on a riser 7 that, when installed in the container maintains the base of the riser 7 at approximately 3.5 inches above the container floor height (i.e., top surface of container floor). The 7 inches between the container floor and the shower base 2 are used to contain the drain piping that is used to remove water from the shower and other components in the bathroom facility. Also shown in FIG. 1 is a toilet 3 that is also mounted on the riser 7 above the top floor surface 8A and the drain portion of the toilet 3 exits down through the bottom of toilet 3 into drain piping positioned in the area between the container floor and the riser 7. Immediately to the left of the toilet 3 is a sink 4.

Figure 2:
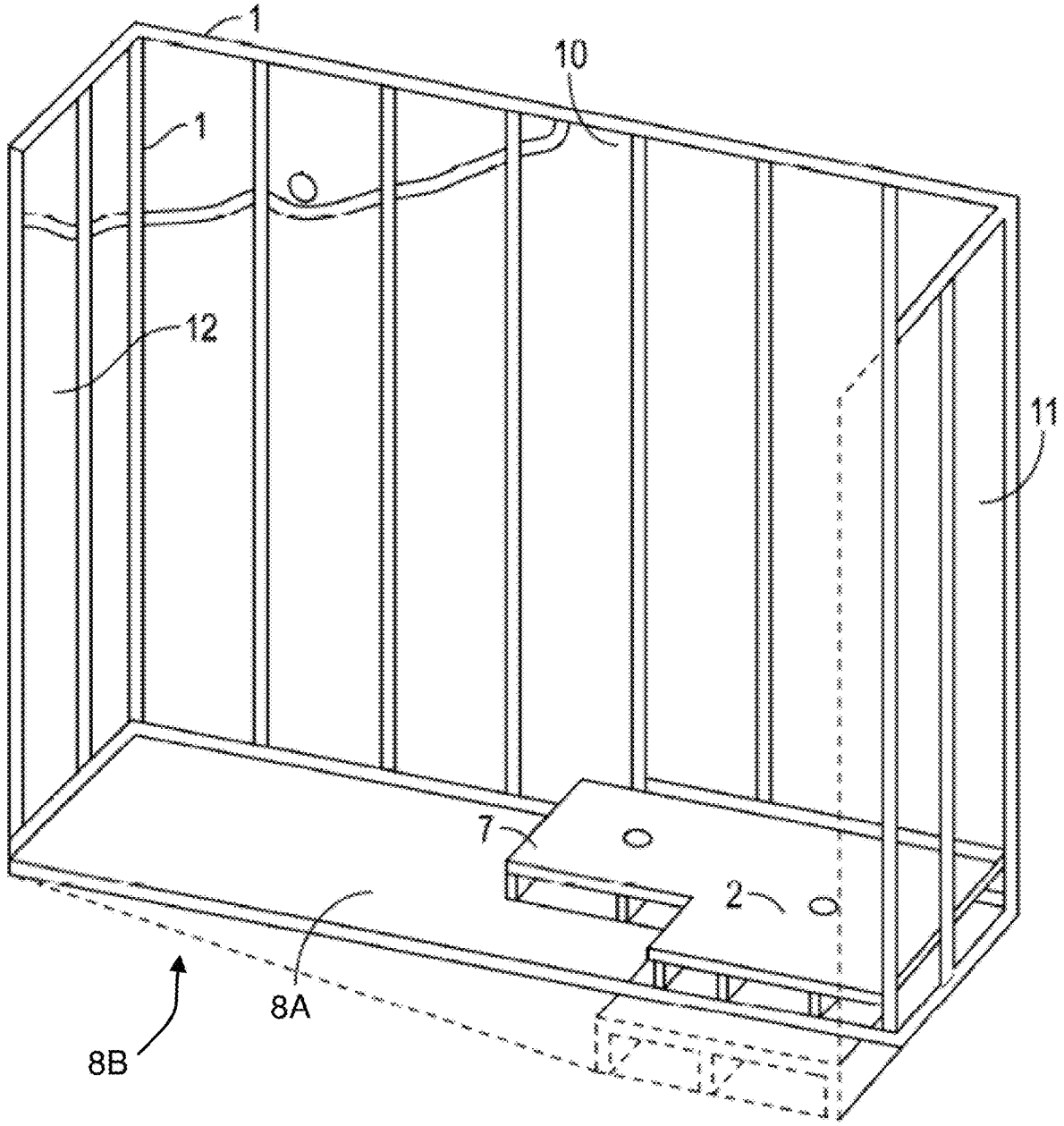
FIG. 2 illustrates the framework for the partial enclosure shown in FIG. 1.

FIG. 2 illustrates the framework for the partial enclosure shown in FIG. 1. The frame design is made from wood or steel studs 1 and screwed together. Then the outside wall covering, for each of back wall 10, right wall 11 and left wall 12 may be screwed to the frame that is made of studs 1. Structural plywood or equivalent material should be used. The floor parts to create riser 7 and floor 8 are made from heavy plywood. Supports of the subfloor between top floor surface 8A and riser 7 are made from 2×4 studs. For a bathtub application instead of a shower base, the subfloor for riser 7, and the right wall 11, will be extended by two feet so a standard size, five foot long bathtub can be set. The frame design may be made from wood or steel studs 1 and screwed together after being brought into the container in separate preassembled panels or pieces that are then secured together to form the bathroom enclosure (e.g., components may be assembled while inside the container structure).

Figure 3:
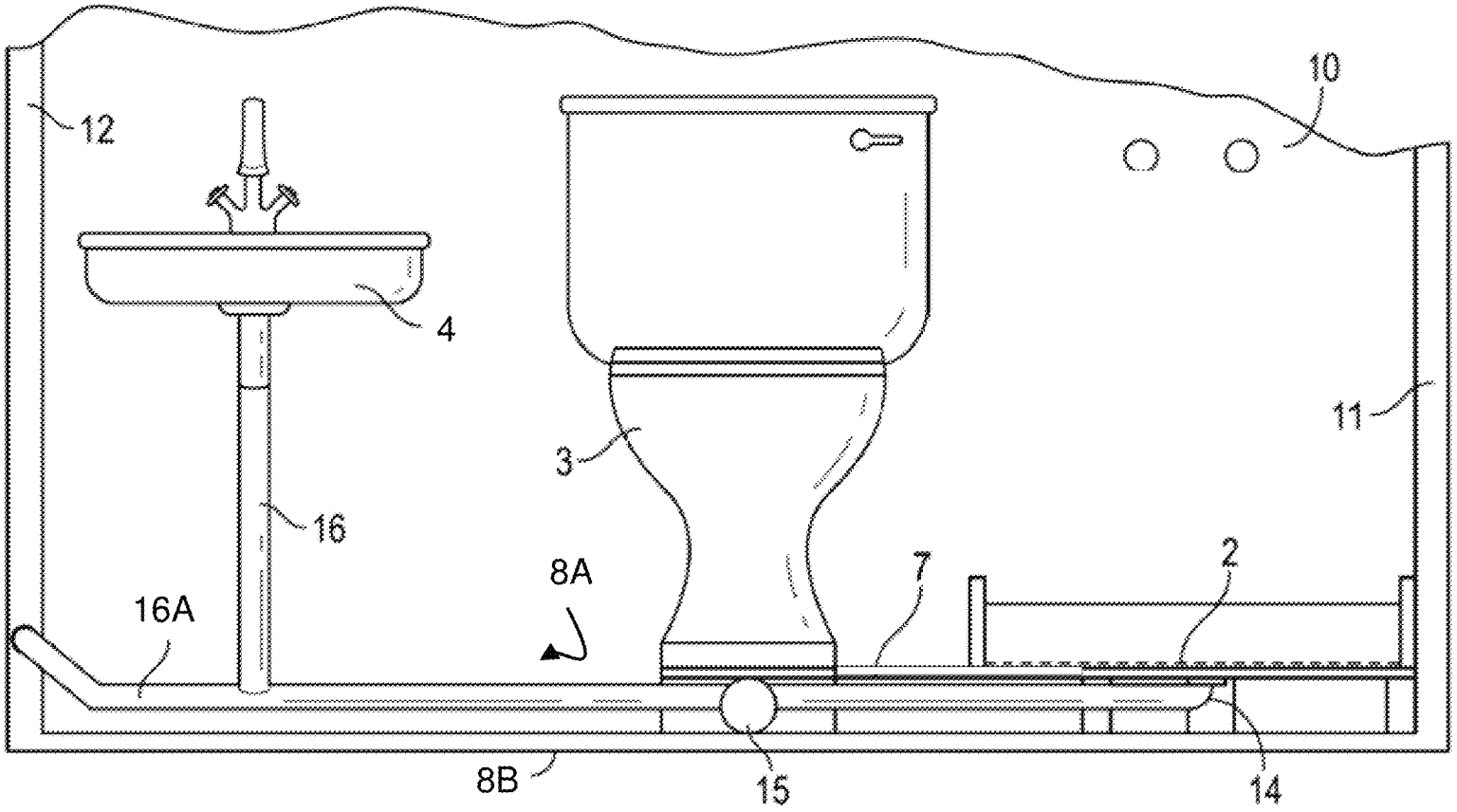
FIG. 3 shows a partial side sectional view of the bathroom appliances with the drain pipes.

FIG. 3 shows a partial side sectional view of the bathroom appliances with their associated drain pipes. Pipe 16 is mounted in the back wall 10. The pipes 14, 16 and 16A are in cavity between sections of floor 8 and/or subfloor riser 7 and the floor of the container adjacent to bottom floor surface 8B. The drain pipe 16A for an optional washing machine (not shown) and kitchen sink drain pipe 16 are inside wall 12, while shower drain pipe 14 shows the siphon for the shower or bathtub. The space below the sub floor 7 that contains a plurality of pipes or conduits to evacuate fluid from the shower, toilet, and sink fixtures. More particularly, this shower basin of shower base 2 may collect fluid into a drain that connects to a shower drain pipe 14 that further connects to a main drain pipe 15. The main drain pipe 15 may also collect from the toilet 3 and from the sink drain pipe 16. The shower drain pipe 14 and the sink drain pipe 16 may be a 1", 1.5", or 2" diameter pipe. The main drain pipe 15 may be a 3" or 3.5" diameter pipe. The pipe used may be PVC plumbing pipe or other type of pipe as required by local rules or code.

Figure 4:
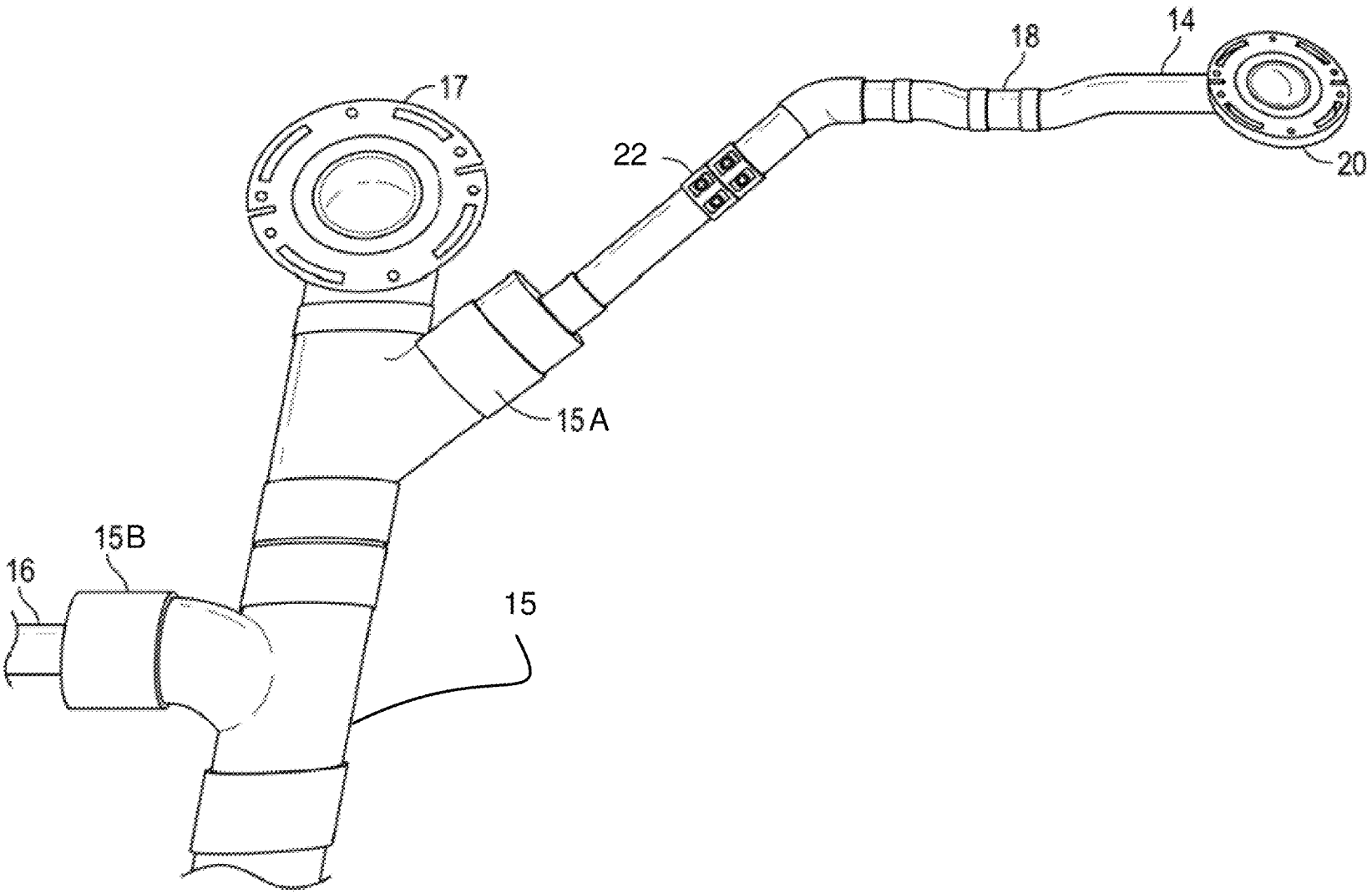
FIG. 4 illustrates an exemplary plumbing assembly to support the enclosure and bathroom appliances shown in FIGS. 1-3.

FIG. 4 illustrates an exemplary piping configuration that may be used to support the modular bathroom facility shown in FIGS. 1 through 3. The exemplary piping configuration includes a shower drain plate 20 that is configured to be mounted in the shower base 2 to receive and drain water from the shower basin. The shower drain plate 20 may connect to the shower drain pipe 14, which also communicates to the main drain pipe 15. The shower drain pipe 14 may typically be have a diameter of between about 1 and about 1½ inches. The main drain pipe 15 may have a diameter of between about 3 and about 3½ inches. The shower drain pipe 14 may also include a gas trap 18 that is configured to prevent gas from traveling in the direction from the main drain pipe 15 toward the shower drain plate 20. The gas trap 18 may generally include a reduction in height between the endpoints of the gas trap 18 so as to trap liquid in the lowest point of the gas trap 18 and thereby prevent gas from traveling through the trap.

The shower drain pipe 14 may also include a check valve (sometimes referred to as a backflow preventer that is shown as backflow preventer 22 and discussed further below). The check valve may operate to only allow fluid flow in one direction, and more particularly, only allow fluid flow in the direction from the shower drain toward the main drain. Use of the check valve may prevent backflow of fluid from the main drain pipe 15 back up into the shower basin of shower base 2. Reverse fluid flow direction may happen when the fluid pressure in the main drain pipe 15 is higher than the fluid pressure in the shower drain pipe 14. This would happen in the case where the main drain pipe 15 was blocked or restricted such that the fluid flow from the toilet may cause an increase in pressure in the main drain pipe 15 that could cause backflow of fluid into the shower.

The exemplary piping configuration may also include a toilet flange 17 attached to the main drain pipe 15, whereby the toilet flange 17 is configured to receive and secure a toilet, such as toilet 3 of FIG. 1, thereto. The typical conduit diameter of the pipe at the toilet flange 17 may be between about three inches and about three and a half inches. The main drain pipe 15 may also communicate with the sink drain pipe 16, which may also be a smaller diameter line, such as a line having a diameter of between about one inch and about one and a half inches. Thus, the piping configuration provides for three bathroom fixtures, the sink 4, toilet 3, and a shower, all to be piped into a single main drain pipe 15.

The exemplary plumbing assembly may also include a backflow preventer 22 inserted in the shower drain line 14 between the shower drain plate 20 and the main drain pipe 15. The purpose of the backflow preventer 22 may be to prevent water from traveling in a direction from the main drain pipe 15 towards the shower drain plate 20, as in certain situations when a toilet flushes and is evacuated into the main drain pipe 15, the fluid pressure in the main drain pipe 15 may be sufficient to overcome the fluid pressure in the shower drain pipe 14, and as such, cause a reverse flow of fluid from the main drain pipe 15 up back into the shower through the shower drain pipe 14 and the shower drain plate 20.

One novel item about the exemplary piping configuration is that the entire assembly shown in FIG. 4 may be contained in the vertical space between the sub floor riser 7 and the container floor that is adjacent to bottom floor surface 8B while still providing sufficient drop or slope in the pipes for proper drainage. This vertical space containing the pipes may be between about five and about seven inches tall, so the piping configuration of the present disclosure provides a very low profile solution that allows for three bathroom fixtures to be mounted on a slightly elevated subfloor while still allowing for proper drainage and slope of the supporting conduits for the bathroom fixtures to be mounted in a very narrow space that encompasses only about seven inches in height. The sink 4 may be similarly closely positioned, thus creating a significant challenge for properly draining all three fixtures. Thus, the novel riser and plumbing structure of the present disclosure allows for three plumbing fixtures (a sink 4, a toilet 3, and a shower) to be positioned very close together (within about three feet) on a minimal height riser (as low as about seven inches) and still provide for adequate slope in the supporting pipe structures or assembly to allow for proper drainage of each of the three fixtures.

Figure 4A:
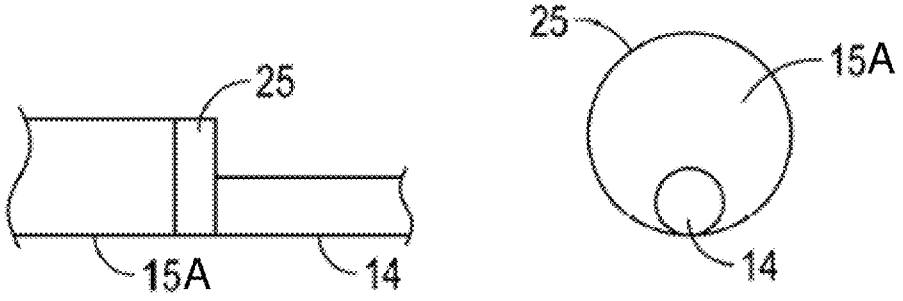
FIG. 4*a* illustrates a side view of the main drain pipe 15 and the shower drain pipe 14 of an exemplary embodiment of the present disclosure.

FIG. 4 illustrates an exemplary plumbing assembly to support the enclosure and bathroom appliances shown in FIGS. 1-3. FIG. 4A illustrates an important part of the plumbing of the exemplary embodiment. For example, the left side of FIG. 4A shows a side view of the plumbing connection between the shower drain pipe 14 and the main drain pipe 15. Specifically, the connection between these two pipes includes a connector 25, which is shown in the right-hand side of FIG. 4A, that includes an eccentrically positioned receptacle 15A for the shower drain pipe 14 to be received into the main drain pipe 15. Receptacle 15B shows a similar eccentrically positioned connection between sink drain pipe 16 to be received into the main drain pipe 15. As an example, the main drain pipe 15 may be a 3-inch diameter pipe in the shower drain pipe 14 (or sink drain pipe 16) may be a 1-inch diameter pipe. Therefore, the shower drain pipe 14 may be positioned eccentrically near the bottom or lowest portion of the main drain pipe 15 via the connector 25. The eccentric position of shower drain pipe 14 allows for the shower drain pipe 14 to slope downward from the connection to the shower drain to toward the main drain pipe 15. This allows for proper flow from the shower into the main drain pipe 15 despite the very shallow space provided beneath the shower base 2 and the floor of the supporting container structure (i.e., the container floor beneath bottom floor surface 8B).

Figure 4B:
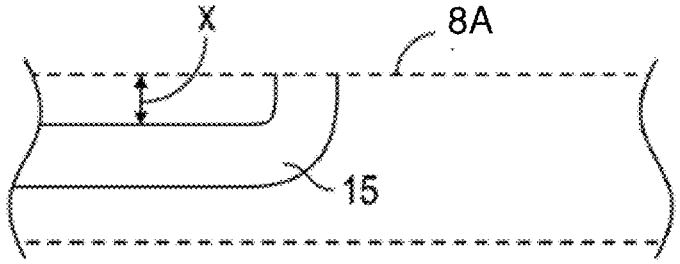
FIG. 4*b* illustrates a side view of the main drain pipe 15 of the plumbing assembly shown in FIG. 4, with a focus on the connection between the main drain pipe 15 and the toilet 3, specifically a tight radius or turn 90 degree elbow element.

FIG. 4B illustrates a side view of the main drain pipe 15 of the plumbing assembly shown in FIGS. 4 and 4A, with a focus on the connection between the main drain pipe 15 and the toilet 3. Specifically a tight radius or turn 90 degree elbow element. The connection generally includes a 90° turn to meet the main drain pipe 15 at a generally horizontal direction from a generally vertical direction (at connection to toilet 3). The generally vertical portion of the main drain pipe 15 then connects to the base of the toilet 3. However, the 90° turn in the present embodiment must be accomplished in a very short vertical distance (see distance x in FIG. 4B), as the vertical spacing between the subfloor (e.g., of riser 7) and the supporting floor where the main drain pipe 15 is positioned is very shallow (includes very little vertical space). As an example, the vertical spacing between the subfloor of riser 7 and the supporting floor may be about seven inches in one exemplary embodiment, and in another exemplary embodiment the vertical spacing may be about four to five inches. As such, the main drain pipe 15 must turn 90° from horizontal to vertical in a very limited amount of vertical space. Typical 90° elbows for three inch pipe may make the 90° turn in approximately ten to twelve inches of vertical space, as such, the standard elbows or 90° connectors will not work in the present embodiment. Therefore, as shown in FIG. 4B, the 90° elbow may be provided with minimal vertical spacing, that is to say that the elbow may turn from horizontal to vertical in about the same diameter as the main drain pipe 15, which is approximately three to four inches in vertical space. As such, the vertical distance X from the top of the main drain pipe 15 to the bottom of the subfloor of riser 7 supporting the bathroom fixtures is generally less than about one to one and a half inches.

The terminating end of the vertical portion of the main drain pipe 15 may have a toilet flange 17 (see FIG. 4) to connect to the toilet 3 affixed thereto, wherein the toilet flange 17 is configured to engage or support the toilet 3 positioned thereon. This toilet flange 17 may be secured to the vertical portion of the main drain pipe 15 by an epoxy are other very strong securing substance that will keep the toilet flange 17 connected to the main drain pipe 15 once the toilet 3 is secured thereto so as to prevent any leakage, breakage, or other separation that would negatively impact the integrity of the entire plumbing assembly disclosed herein. Since the three inch main drain pipe 15 is subject to the very strong 90° angle to turn upward towards the toilet flange 17, the connection between the toilet flange 17 and the main drain pipe 15 may include mating the elongated or oval-shaped cross section of the main drain pipe 15 to the circular pipe receiving portion of the toilet flange 17. This connection must be very carefully affixed together, with sufficient strength epoxy for example, so that the oval or elongated pipe cross section of the main drain 15 may properly sealed to the toilet flange 17 to prevent any fluid leaks.

Figure 5:
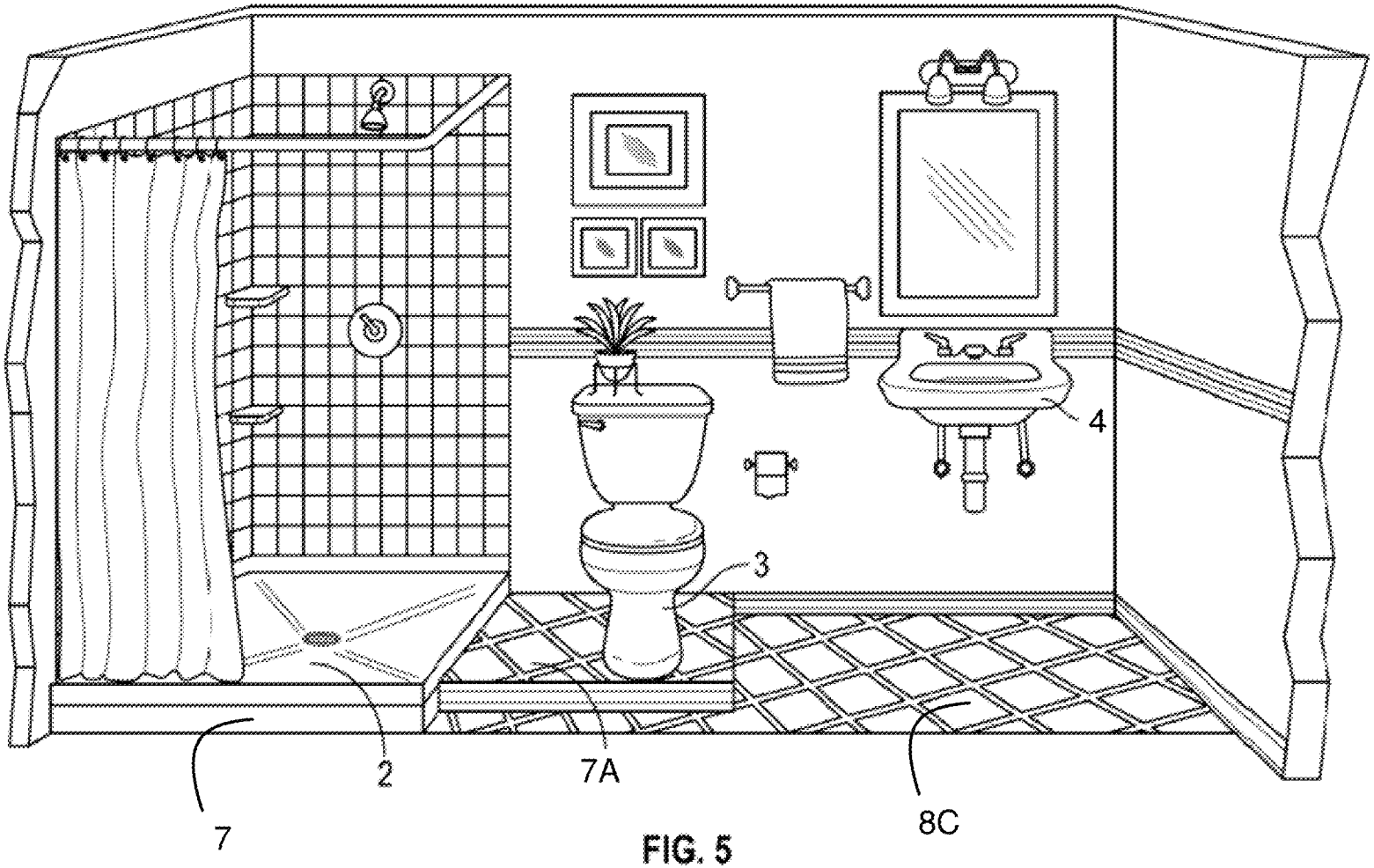

FIG. 5 illustrates an exemplary final installation of the novel plumbing assembly of the present disclosure that support three bathroom fixtures, namely a shower or tub, a toilet 3, and a sink 4, all on a raised platform (e.g., subfloor 8 and/or riser 7 discussed above) that is between five and seven inches off a base floor (container floor) within which the present plumbing assembly is mounted in. It's worth noting that there is a very slight or minimal elevation of the platform or subfloor 7 above the main floor of the structure (shipping container). This elevation, as described above, is generally between about four and seven inches, which is enough to accommodate the exemplary plumbing assembly described above that allows for the shower, toilet 3, and sink 4 all to drain in to a plumbing assembly that is positioned above the main floor of the structure yet below the subfloor 7 of the structure. Therefore, there is no need for any penetrations, holes, or other throughput of pipes or other plumbing through the main floor of the structure, which may generally be a steel shipping container. Being able to provide standard plumbing features like a shower, toilet 3, and a sink 4 into a modular bathroom provided within a shipping container without penetrating the floor of the shipping container is both novel and desirable for those building homes within shipping containers.

In the preceding, reference is made to embodiments presented in this disclosure. However, the scope of the present disclosure is not limited to specific described embodiments. Instead, any combination of the following features and elements, whether related to different embodiments or not, is contemplated to implement and practice contemplated embodiments. Furthermore, although embodiments disclosed herein may achieve advantages over other possible solutions or over the prior art, whether or not a particular advantage is achieved by a given embodiment is not limiting of the scope of the present disclosure. Thus, the preceding aspects, features, embodiments and advantages are merely illustrative and are not considered elements or limitations of the appended claims except where explicitly recited in a claim(s). Likewise, reference to "the invention" shall not be construed as a generalization of any inventive subject matter disclosed herein and shall not be considered to be an element or limitation of the appended claims except where explicitly recited in a claim(s). While the foregoing is directed to embodiments presented in this disclosure, other and further embodiments may be devised without departing from the basic scope of contemplated embodiments, and the scope thereof is determined by the claims that follow.

What is claimed is:

1. A plumbing assembly to support a modular bathroom positioned within a shipping container, comprising:

a subfloor positioned above a main floor of a shipping container, the subfloor to provide a gap of five inches or less between the subfloor and the main floor;

a riser on a portion of the subfloor to position the riser to provide an increased gap of seven inches or less between the riser and the main floor;

a toilet positioned on the riser of the subfloor;

a shower positioned on the riser of the subfloor;

a sink positioned on a vertical wall above the subfloor adjacent the riser;

a plumbing assembly positioned within the gap and the increased gap, wherein the plumbing assembly receives fluid from the shower, the toilet, and the sink, the plumbing assembly comprising:

a main drain pipe positioned in the gap, fluidly connected to the shower, the toilet, and the sink simultaneously;

a shower drain pipe connected to the shower and communicating fluid therefrom, the shower drain pipe positioned in the increased gap and having a gas trap therein;

a sink drain pipe connected to the sink and communicating fluid therefrom to the main drain pipe, the sink drain pipe positioned in the gap; and wherein the main drain pipe has a diameter that is 3 times larger than a diameter of the shower drain pipe and wherein the shower drain pipe is connected to the main drain pipe in an eccentric position and at a radial position of the main drain pipe closest to the main floor of the shipping container.

2. The plumbing assembly to support a modular bathroom positioned within a shipping container of claim 1, further comprising the diameter of the main drain pipe being 3 inches and the diameter of the shower drain pipe being 1 inch.

3. The plumbing assembly to support a modular bathroom positioned within a shipping container of claim 2, wherein the main drain pipe connects to the toilet base through a 90 degree elbow that has a height of less than 3.5 inches and completes the 90 degree turn in a vertical span of less than three inches.

4. The plumbing assembly to support a modular bathroom positioned within a shipping container of claim 3, wherein the main drain pipe 90 degree elbow has an elongated or oval cross section at a terminating end thereof that connects to a toilet base flange that has a circular cross section.

5. The plumbing assembly to support a modular bathroom positioned within a shipping container of claim 4, wherein the toilet base flange connects to the terminating end of the main drain pipe with an epoxy.

6. The plumbing assembly to support a modular bathroom positioned within a shipping container of claim 1, further comprising a backflow preventer positioned in the shower drain pipe between a shower base and the main drain pipe, the backflow preventer operating to allow fluid flow in a first direction from the shower base toward the main drain pipe and restrict fluid flow in a second direction from the main drain pipe toward the shower base.

7. The plumbing assembly to support a modular bathroom positioned within a shipping container of claim 1, wherein the sink drain pipe connects to the main drain pipe at an eccentric position, wherein the diameter of the main drain pipe is 3 times larger than a diameter of the sink drain pipe, and wherein the sink drain pipe is connected to the main drain pipe in an eccentric position radially at a location closest to the main floor of the shipping container.

* * * * *